US009663740B2

(12) United States Patent
Mead et al.

(10) Patent No.: US 9,663,740 B2
(45) **Date of Patent: *May 30, 2017**

(54) POLYMERIC IMIDES AS POUR POINT DEPRESSANT ADDITIVES FOR OIL COMPOSITIONS

(71) Applicant: Akzo Nobel N.V., Arnhem (NL)

(72) Inventors: Stephen L. Mead, Danbury, CT (US); Rodney Lee Cravey, Manvel, TX (US); Mohammad Abdur Rahman, Pomona, NY (US)

(73) Assignee: AKZO NOBEL N.V., Arnhem (NL)

( * ) Notice: Subject to any disclaimer, the term of this patent is extended or adjusted under 35 U.S.C. 154(b) by 635 days.

This patent is subject to a terminal disclaimer.

(21) Appl. No.: 13/846,110

(22) Filed: Mar. 18, 2013

(65) Prior Publication Data

US 2013/0219775 A1 Aug. 29, 2013

Related U.S. Application Data

(63) Continuation of application No. 11/703,972, filed on Feb. 8, 2007, now abandoned, which is a continuation-in-part of application No. 11/574,349, filed as application No. PCT/EP2005/003638 on Apr. 5, 2005, now Pat. No. 7,942,941.

(60) Provisional application No. 60/559,850, filed on Apr. 6, 2004.

(51) Int. Cl.

| | |
|---|---|
| ***C10L 10/16*** | (2006.01) |
| ***C10L 1/232*** | (2006.01) |
| ***C10L 1/224*** | (2006.01) |
| ***C10L 1/236*** | (2006.01) |
| ***C10L 10/14*** | (2006.01) |
| ***C10M 149/06*** | (2006.01) |

(52) U.S. Cl.

CPC ..... *C10L 10/16* (2013.01); *C10L 1/224* (2013.01); *C10L 1/232* (2013.01); *C10L 1/2364* (2013.01); *C10L 10/14* (2013.01); *C10M 149/06* (2013.01); *C10M 2203/1006* (2013.01); *C10M 2205/028* (2013.01); *C10M 2207/2805* (2013.01); *C10M 2207/401* (2013.01); *C10N 2230/08* (2013.01)

(58) Field of Classification Search

USPC ..... 44/388, 347; 137/13; 548/547

See application file for complete search history.

(56) References Cited

U.S. PATENT DOCUMENTS

| | | | | |
|---|---|---|---|---|
| 2,542,542 | A | 2/1951 | Lippincott et al. | |
| 2,615,845 | A | 10/1952 | Lippincott et al. | |
| 3,003,858 | A | 10/1961 | Andress, Jr. et al. | |
| 3,675,671 | A * | 7/1972 | Sweeney et al. | 137/13 |
| 3,905,781 | A | 9/1975 | Dorn | |
| 4,147,520 | A | 4/1979 | Ilnyckyj | |
| 4,163,645 | A | 8/1979 | Cheng | |
| 4,211,534 | A | 7/1980 | Feldman | |
| 4,339,246 | A | 7/1982 | Yamamura et al. | |
| 4,356,002 | A | 10/1982 | Knepper et al. | |
| 4,491,455 | A | 1/1985 | Ishizaki et al. | |
| 4,670,516 | A | 6/1987 | Sackmann et al. | |
| 2001/0013196 | A1 * | 8/2001 | Krull et al. | 44/388 |
| 2003/0163951 | A1 | 9/2003 | Eydoux et al. | |
| 2005/0113266 | A1 | 5/2005 | Krull et al. | |
| 2005/0126072 | A1 | 6/2005 | Krull et al. | |

FOREIGN PATENT DOCUMENTS

| | | | |
|---|---|---|---|
| EP | 0061895 | A2 | 10/1982 |
| EP | 0177108 | A2 | 8/1984 |
| EP | 0153176 | A2 | 8/1985 |
| EP | 0153177 | B1 | 8/1985 |
| EP | 0154177 | | 9/1986 |
| EP | 0225688 | B1 | 6/1987 |
| EP | 0326356 | | 8/1989 |
| EP | 0327427 | A1 | 8/1989 |
| EP | 1526167 | A2 | 4/2005 |
| EP | 1541662 | A1 | 6/2005 |
| GB | 1463291 | | 2/1977 |
| JP | 59-8790 | A | 1/1984 |
| JP | 61-296090 | A | 12/1986 |
| JP | 2-51477 | A | 7/1990 |
| JP | 3-34790 | A | 5/1991 |
| WO | WO91/11488 | A1 | 8/1991 |
| WO | WO91/16407 | A1 | 10/1991 |
| WO | WO93/04148 | A1 | 3/1993 |
| WO | WO01/48122 | A1 | 7/2001 |

OTHER PUBLICATIONS

Derwent Abstract 004852104 of EP0327427A1.
Derwent Abstract 0003429874 of JP2-51477.
Derwent Abstract 0003435389 of JP3-34790.
Derwent Abstract XP-002343279 of JP59008790A.
Derwent Abstract XP-002343177 of JP61296090A.
Comb-Like Polymers, Structure and Properties, N.A. Plate et al, J. Polymer Sci: Macromolecular Reviews, vol. 8, pp. 117-253 (1974).
TOLAD® Additive Progeam, Additives—Cold Flow Improvers, Baker Hughes Incorporated, pp. 1-3 (2005).
Advanced Chemical Solutions from Baker Perrolite which Prevent Organic . . . Oil and Gas Production—Paraffin & Asphaltene Controllers, Bakers Hughes Incorporated pp. 1-3 (2005).
English Translation of Chinese Patent Appl. No. 200580018372.6, dated Jul. 16, 2010.
International Search Report of International Patent Appl. No. PCT/EP2005/003638, dated Sep. 12, 2005.

* cited by examiner

*Primary Examiner* — Ellen McAvoy
*Assistant Examiner* — Chantel Graham
(74) *Attorney, Agent, or Firm* — Matthew D. Kellam

(57) ABSTRACT

The present invention generally relates to oil compositions, primarily to fuel oil and petroleum compositions produced there from susceptible to wax formation at low temperatures, to polymeric imides for use with such fuel oil compositions, and to methods for their manufacture.

17 Claims, No Drawings

POLYMERIC IMIDES AS POUR POINT DEPRESSANT ADDITIVES FOR OIL COMPOSITIONS

This application is a continuation of U.S. patent application Ser. No. 11/703,972, filed Feb. 8, 2007, now abandoned, which is a continuation-in-part of U.S. patent application Ser. No. 11/547,349, filed Sep. 29, 2006, now U.S. Pat. No. 7,942,941, which is a National Stage entry of International Application PCT/EP2005/003638, filed on Apr. 5, 2005, which claims the benefit of U.S. Patent Application No. 60/559,850, filed Apr. 6, 2004. The contents of the aforementioned applications are incorporated herein by reference in their entireties.

FIELD OF THE INVENTION

The present invention generally relates to polymeric imides useful as pour point depressants and their use in providing oils with improved low temperature flow properties.

BACKGROUND OF THE INVENTION

The present invention generally relates to oil compositions, primarily to fuel oil and petroleum compositions produced there from susceptible to wax formation at low temperatures, to polymeric imides for use with such fuel oil compositions, and to methods for their manufacture.

Fuel oils and/or petroleum products, whether derived from petroleum or vegetable sources, contain components, e.g., paraffins, alkanes, etc. that at low temperature tend to precipitate as large crystals or spherulites of wax in such a way as to form a gel structure which causes the oil to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets; certain additives inhibit this and cause the wax to adopt an acicular habit, the resulting needles being more likely to pass through a filter than are platelets. The additives may also suspend in the fuel the crystals that have formed, the resulting reduced settling also assisting in prevention of blockages.

Effective wax crystal modification (as measured by cold filter plugging point (CFPP), (ASTM D97-66) and other operability tests, as well as simulated and field performance are known in the art. However, there is a continual need in the art to produce more effective polymers giving improved performance.

Surprisingly, the present inventors have found more effective and economical additives. In particular, applicant has found that certain polymeric imides can effectively and economically be employed as pour point depressants for various grades of crude and fuel oil.

SUMMARY OF THE INVENTION

The present invention generally relates to an oil composition having improved low temperature properties comprising oil and an effective amount of a pour point depressant additive composition that comprises at least one pour point depressant additive of the following formula.

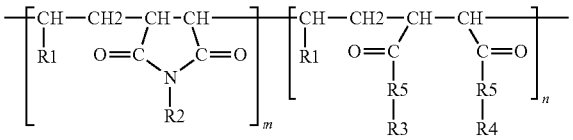

wherein $R^1$ is H or a hydrocarbyl group having from 1 to 50 carbon atoms, $R^2$, $R^3$ and $R^4$ are independently selected from hydrogen or hydrocarbyl groups containing from 1 up to 50 carbon atoms, m is an integer of from 1 to 50, n is an integer of from 0 to 50, and each $R^5$ groups may be any possible combination of O and NH groups on the polymer.

The invention also relates to a pour point depressant additive composition, a pour point depressant additive concentrate composition and a method of improving the low temperature flow properties of a composition that comprises in major part at least one oil, said method comprising admixture of the composition comprising said at least one oil with an effective amount of the aforementioned pour point depressant additive and/or additive concentrate.

DETAILED DESCRIPTION OF THE INVENTION

The present invention generally relates to a pour point depressant additive composition that comprises at least one polymeric imide as hereinafter described.

In a second aspect, this invention relates to a pour point depressant additive concentrate composition comprising the aforementioned pour point depressant additive and a compatible solvent thereof.

In a third aspect, the invention provides an oil composition with improved low temperature flow properties comprising oil and an amount of the aforementioned pour point depressant additive and/or additive concentrate.

In a fourth embodiment the invention relates to a method of improving the low temperature flow properties of a composition that comprises in major part at least one oil, said method comprising admixture of the composition comprising said at least one oil with an effective amount of the aforementioned pour point depressant additive and/or additive concentrate.

The pour point depressant additive of the present invention comprises at least one polymeric imide of General Formulae I:

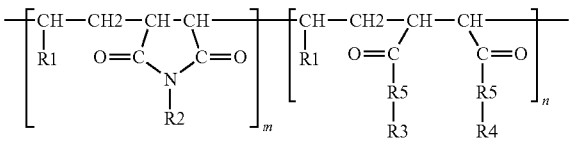

wherein each $R^1$ is H or a hydrocarbyl group having from 1 to 50 carbon atoms, $R^2$, $R^3$ and $R^4$ are independently selected from hydrogen or hydrocarbyl groups containing from 1 up to 50 carbon atoms, m is an integer of from 1 to 50, n is an integer of from 0 to 50 and each $R^5$ group may be any possible combination of O and NH groups on the polymer. The $R^5$ groups may exclusively be O or NH on the polymer.

As used herein the term "hydrocarbyl" refers to a group having a carbon atoms directly attached to the rest of the molecule and having a hydrocarbon or predominantly hydrocarbon character. Among these, there may be mentioned hydrocarbon groups, including aliphatic, (e.g., alkyl), alicyclic (e.g., cycloalkyl), aromatic, aliphatic and alicyclic-substituted aromatic, and aromatic-substituted aliphatic and alicyclic groups. Aliphatic groups can be saturated or unsaturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulphur, and, preferably, oxygen. Advantageously, the hydrocarbyl group contains at most 36, preferably at most 15, more preferably at most 10 and most preferably at most 8, carbon atoms.

In one embodiment $R^1$ is a $C_6$-$C_{40}$ saturated or unsaturated substituted or unsubstituted alkyl group; $R^2$ is a $C_6$-$C_{30}$ saturated or unsaturated substituted or unsubstituted alkyl group; and n is an integer of from 1-30. In another embodiment $R^1$ is a $C_8$-$C_{24}$ saturated or unsaturated substituted or unsubstituted alkyl group; $R^2$ is a $C_8$-$C_{24}$ saturated or unsaturated substituted or unsubstituted alkyl group; and n is an integer of from 1-20. In still another embodiment $R^1$ is a $C_{12}$-$C_{22}$ saturated or unsaturated substituted alkyl group; $R^2$ is a $C_{12}$-$C_{22}$ saturated or unsaturated substituted or unsubstituted alkyl group; and n is an integer of from 1-10

The products of the present invention are generally prepared by reacting an (a) alpha olefin with (b) maleic anhydride in the presence of a free radical initiator such as, for example, tert-butyl peroxybenzoate (other free radical initiators useful in the context of the present invention are known to those skilled in the art) in order to form (c) a high molecular weight copolymer. This copolymer is then reacted with an (d) amine to form the imide. In order to produce high yields of the imide, reaction temperatures of from about 220° C., or higher, are preferred.

It is understood that any alpha olefin of varying carbon chain length can be employed in order to make the products of the invention. In one embodiment the a) alpha olefin is a $C_6$-$C_{24}$ alpha olefin; in another embodiment it is a $C_{12}$-$C_{24}$ alpha olefin, in another embodiment it is a $C_{20}$-$C_{24}$ alpha olefin, and still another it is a $C_{24}$-$C_{28}$ alpha olefin.

In one embodiment the high molecular weight copolymer is of the formula:

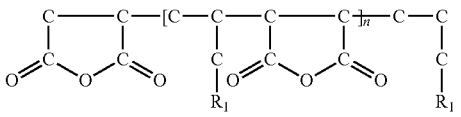

The amines employable in the reaction with the high molecular weight copolymer can be any amine commercially available that reacts with such copolymer. Preferably, the amine is of the formula:

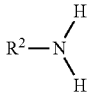

where $R^2$ is an alkylene group of from 6 to 30 carbon atoms. Nonlimiting examples of amines suitable for use include but are not limited to tallowamine, hydrogenated tallowamine, cocoamine, soyamine, oleylamine, octadecylamine, hexadecylamine, dodecylamine, 2-ethylhexylamine, dicocoamine, ditallowamine, dehydrogenated tallowamine, didecylamine, dioctadecylamine, N-coco-1,3-diaminopropane, N-tallow-1,3-diaminopropane, N,N,N-trimethyl-N-tallow-1,3-diaminopropane, N-oleyl-1,3-diaminopropane, N,N<N-trimethyl-N-9-octadecenyl-1,3-diaminopropane, 3-tallowalkyl-1,3-hexahydropyrimidine and mixtures thereof.

The reaction of the high molecular weight copolymer and amine may be conducted in the presence of at least one alcohol to yield a mixture of imides and esters on the copolymer chain. Alcohols generally contain from 1 up to 50 carbon atoms. In one embodiment of the invention, alcohols that can usefully be employed include, but are not limited to methanol, ethanol, propanol, isopropanol, butanol, isobutanol $C_{10}$-$C_{20+}$ alcohol blends, $C_{12}$-$C_{-36}$ Guerbet alcohols, Behenyl alcohols, and mixtures thereof. Under mild conditions it is possible to obtain a combination of imides, amides and esters. Under milder conditions it is possible to obtain a mixture with a majority of amide and ester structures. In the absence of alcohols, amides and imides may be formed exclusively.

The polymer may be made by any of the methods known in the art, e.g., by solution polymerization with free radical initiation, or by high pressure polymerization, conveniently carried out in an autoclave or a tubular reactor.

In order to prepare mixtures of esters, imides and amides on the copolymer, alcohols may be mixed with the amines at any alcohol/amine ratio to form a mixture of imide, ester and amide. The amount of attachment may vary from 0.1 to 2.0 moles of combined alcohol and amine for each mole of maleic anhydride employed. The full ester structure is then made by reacting the copolymer with the amine/alcohol which can be run at any water-producing temperature with or without solvent. This reaction may be run at lower temperatures to produce more of the amide structures. At milder conditions an amide or amide+ester may be the only products generated. In one embodiment, examples of preferred imides+esters+amides that can be usefully employed in the context of the present invention include, but are not limited to imides+esters+amides derived from the reaction maleic anhydride with at least one of the following amines: tallowamine, hydrogenated tallowamine, cocoamine, soyamine, oleylamine, octadecylamine, hexadecylamine, dodecylamine, 2-ethylhexylamine, dicocoamine, ditallowamine, dehydrogenated tallowamine, didecylamine, dioctadecylamine, N-coco-1,3-diaminopropane, N-tallow-1,3-diaminopropane, N,N,N-trimethyl-N-tallow-1,3-diaminopropane, N-oleyl-1,3-diaminopropane, N,N<N-trimethyl-N-9-octadecenyl-1,3-diaminopropane, 3-tallowalkyl-1,3-hexahydropyrimidine and mixtures thereof in combination with the alcohols: methanol, ethanol, propanol, isopropanol, butanol, isobutanol $C_{10}$-$C_{20+}$ alcohol blends, $C_{12}$-$C_{-36}$ Guerbet alcohols, Behenyl alcohols and mixtures thereof.

As indicated above, the polymeric imides of the invention may contain a mixture of different species. It is also within the scope of the invention to provide a composition comprising a mixture of two or more of said polymers.

The pour point depressant additive of the present invention is especially useful in crude and/or fuel oils having a relatively high wax content, e.g., a wax content of 0.1 to 20% by weight per weight of fuel, preferably 3.0 to 4.5, such as 3.5 to 4.5% wt, measured at 10° C. below wax appearance temperature (WAT).

The polymer is preferably soluble in the oil to the extent of at least 10,000 ppm by weight per weight of oil at ambient temperature. However, at least some of the additive may come out of solution near the cloud point of the oil and function to modify the wax crystals that form.

The pour point depressant additive of the present invention can be employed alone, or it may be combined with other additives for improving low temperature flowability and/or other properties, which are in use in the art or known from the literature. The pour point depressant additive composition may also comprise additional cold flow improvers, including but not limited to comb polymers, polar nitrogen compounds, compounds containing a cyclic ring system, hydrocarbon polymer, polyoxyalkylene compounds, mixtures thereof and the like.

Comb polymers—are polymers in which branches containing hydrocarbyl groups are pendant from a polymer backbone, and are discussed in "Comb-Like Polymers. Structure and Properties", N. A. Plate and V. P. Shibaev, J. Poly. Sci. Macromolecular Revs., 8, p 117 to 253 (1974), which is incorporated herein by reference.

Generally, comb polymers have one or more long chain hydrocarbyl branches, e.g., oxyhydrocarbyl branches, normally having from 10 to 30 carbon atoms, pendant from a polymer backbone, said branches being bonded directly or indirectly to the backbone. Examples of indirect bonding include bonding via interposed atoms or groups, which bonding can include covalent and/or electrovalent bonding such as in a salt.

Advantageously, the comb polymer is a homopolymer or a copolymer having at least 25 and preferably at least 40, more preferably at least 50, molar percent of the units of which have side chains containing at least 6, and preferably at least 10, atoms.

These comb polymers may be copolymers of maleic anhydride or fumaric or itaconic acids and another ethylenically unsaturated monomer, e.g., an alpha-olefin, including styrene, or an unsaturated ester, for example, vinyl acetate or homopolymer of fumaric or itaconic acids. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1-tetradecene, 1-hexadecene, and 1-octadecene.

The acid or anhydride group of the comb polymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan1-ol or 2-methyltridecan-1-ol. The alcohol may be a mixture of normal and single methyl branched alcohols.

These comb polymers may especially be fumarate or itaconate polymers and copolymers such for example as those described in EP-A-153176, -153177 and -225688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight. The particularly preferred comb polymers are those having a number average molecular weight, as measured by vapor phase osmometry, of 1,000 to 100,000, more especially 1,000 to 30,000.

Other suitable comb polymers are the polymers and copolymers of alpha-olefins and esterified copolymers of styrene and maleic anhydride, and esterified copolymers of styrene and fumaric acid; mixtures of two or more comb polymers may be used in accordance with the invention and, as indicated above, such use may be advantageous. Other examples of comb polymers are hydrocarbon polymers, e.g., copolymers of ethylene and at least one alpha-olefin, the alpha-olefin preferably having at most 20 carbon atoms, examples being n-decene-1 and n-dodecene-1. Preferably, the number average molecular weight of such a copolymer is at least 30,000 measured by GPC. The hydrocarbon copolymers may be prepared by methods known in the art, for example using a Ziegler type catalyst.

Polar nitrogen compounds. Such compounds are oil-soluble polar nitrogen compounds carrying one or more, preferably two or more, substituents of the formula $>NR_{13}$, where $R_{13}$ represents a hydrocarbyl group containing 8 to 40 atoms, which substituent or one or more of which substituents may be in the form of a cation derived therefrom. The oil soluble polar nitrogen compound is generally one capable of acting as a wax crystal growth inhibitor in fuels, it comprises for example one or more of the following compounds:

An amine salt and/or amide formed by reacting at least one molar proportion of a hydrocarbyl-substituted amine with a molar proportion of a hydrocarbyl acid having from 1 to 4 carboxylic acid groups or its anhydride, the substituent(s) of formula $>NR_{13}$ being of the formula $—NR_{13}R_{14}$ where $R_{13}$ is defined as above and $R_{14}$ represents hydrogen or $R_{13}$, provided that $R_{13}$ and $R_{14}$ may be the same or different, said substituents constituting part of the amine salt and/or amide groups of the compound.

Ester/amides may be used, containing 30 to 300, preferably 50 to 150, total carbon atoms. These nitrogen compounds are described in U.S. Pat. No. 4,211,534. Suitable amines are predominantly $C_{12}$ to $C_{40}$ primary, secondary, tertiary or quaternary amines or mixtures thereof but shorter chain amines may be used provided the resulting nitrogen compound is oil soluble, normally containing about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but are preferably secondary. Tertiary and quaternary amines only form amine salts. Examples of amines include tetradecylamine, cocoamine, and hydrogenated tallow amine. Examples of secondary amines include dioctadecyl amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% C14, 31% C16, and 59% C18.

Examples of suitable carboxylic acids and their anhydrides for preparing the nitrogen compounds include ethylenediamine tetraacetic acid, and carboxylic acids based on cyclic skeletons, e.g., cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactones. Generally, these acids have about 5 to 13 carbon atoms in the cyclic moiety. Preferred acids useful in the present invention are benzene dicarboxylic acids e.g., phthalic acid, isophthalic acid, and terephthalic acid. Phthalic acid and its anhydride are particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

Other examples are long chain alkyl or alkylene substituted dicarboxylic acid derivatives such as amine salts of monoamides of substituted succinic acids, examples of which are known in the art and described in U.S. Pat. No. 4,147,520, for example, which is incorporated herein by reference. Suitable amines may be those described above.

Other examples are condensates, for example, those described in EP-A-327427.

Compounds containing a cyclic ring system—carrying at least two substituents of the general formula below on the ring system $$-A-NR_{15}R_{16}$$

where A is a linear or branched chain aliphatic hydrocarbylene group optionally interrupted by one or more hetero atoms, and $R_{15}$ and $R_{16}$ are the same or different and each is independently a hydrocarbyl group containing 9 to 40 atoms optionally interrupted by one or more hetero atoms, the substituents being the same or different and the compound optionally being in the form of a salt thereof. Advantageously, A has from 1 to 20 carbon atoms and is preferably a methylene or polymethylene group. Such compounds are described in WO 93/04148.

Hydrocarbon polymer. Examples of suitable hydrocarbon polymers are those of the general formula $$CxHy$$

where x=1-40 and y=sufficient number of hydrogens to make all carbons tetravalent. The hydrocarbon polymers may be made directly from monoethylenically unsaturated monomers or indirectly by hydrogenating polymers from polyunsaturated monomers, e.g., isoprene and butadiene. Examples of hydrocarbon polymers are disclosed in WO 91/11488.

Preferred copolymers are ethylene alpha-olefin copolymers, having a number average molecular weight of at least 30,000. Preferably the alpha-olefin has at most 28 carbon atoms. Examples of such olefins are propylene, n-butene, isobutene, n-octene-1, isooctene-1, n-decene-1, and n-dodecene-1. The copolymer may also comprise small amounts, e.g., up to 10% by weight, of other copolymerizable monomers, for example olefins other than alpha-olefins, and non-conjugated dienes. The preferred copolymer is an ethylene-propylene copolymer.

The number average molecular weight of the ethylene alphaolefin copolymer is, as indicated above, preferably at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 percent. More advantageously, the ethylene content is within the range of from 57 to 80%, and preferably it is in the range from 58 to 73%; more preferably from 62 to 71%, and most preferably 65 to 70%.

Preferred ethylene alpha-olefin copolymers are ethylene-propylene copolymers with a molar ethylene content of from 62 to 71% and a number average molecular weight in the range 60,000 to 120,000; especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

Other suitable hydrocarbon polymers include a low molecular weight ethylene-alpha-olefin copolymer, advantageously with a number average molecular weight of at most 7,500, advantageously from 1,000 to 6,000, and preferably from 2,000 to 5,000, as measured by vapor phase osmometry. Appropriate alpha-olefins are as given above, or styrene, with propylene again being preferred. Advantageously the ethylene content is from 60 to 77 molar percent, although for ethylene-propylene copolymers up to 86 molar percent by weight ethylene may be employed with advantage.

The hydrocarbon polymer may most preferably be an oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations.

Advantageously, the block copolymer before hydrogenation comprises units derived from butadiene only, or from butadiene and at least one comonomer of the formula $$CH_2{=}CR_1{-}CR_2{=}CH_2$$

wherein $R_1$ represents a $C_1$ to $C_8$ alkyl group and $R_2$ represents hydrogen or a $C_1$ to $C_8$ alkyl group. Advantageously the total number of carbon atoms in the comonomer is 5 to 8, and the comonomer is advantageously isoprene. Advantageously, the copolymer contains at least 10% by weight of units derived from butadiene.

In general, the crystallizable block or blocks will be the hydrogenation product of the unit resulting from predominantly 1,4- or end-to-end polymerization of butadiene, while the non-crystallizable block or blocks will be the hydrogenation product of the unit resulting from 1,2-polymerization of butadiene or from 1,4-polymerization of an alkyl-substituted butadiene.

A polyoxyalkylene compound. Examples are polyoxyalkylene esters, ethers, ester/ethers and mixtures thereof, particularly those containing at least one, preferably at least two, C10 to C30 linear alkyl groups and a polyoxyalkylene glycol group of molecular weight up to 5,000, preferably 200 to 5,000, the alkyl group in said polyoxyalkylene glycol containing from 1 to 4 carbon atoms. These materials form the subject of EP-A-0 061 895. Other such additives are described in U.S. Pat. No. 4,491,455.

The preferred esters, ethers or ester/ethers are those of the general formula $$R_{31}—O(D)-O—R_{32}$$

where $R_{31}$ and $R_{32}$ may be the same or different and represent (a) n-alkyl- (b) n-alkyl-CO—

(c) n-alkyl-O—CO(CH2)x- or (d) n-alkyl-O—CO(CH2)x-CO— x being, for example, 1 to 30, the alkyl group being linear and containing from 10 to 30 carbon atoms, and D representing the polyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be present but it is preferred that the glycol is substantially linear. D may also contain nitrogen.

Examples of suitable glycols are substantially linear polyethylene glycols (PEG) and polypropylene glycols (PPG) having a molecular weight of from 100 to 5,000, preferably from 200 to 2,000. Esters are preferred and fatty acids containing from 10-30 carbon atoms are useful for reacting with the glycols to form the ester additives, it being preferred to use a C18-C24 fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred for use in narrow boiling distillates, when minor amounts of monoethers and monoesters (which are often formed in the manufacturing process) may also be present. It is preferred that a major amount of the dialkyl compound be present. In particular, stearic or behenic diesters of polyethylene glycol, polypropylene glycol or polyethylene/polypropylene glycol mixtures are preferred.

Other examples of polyoxyalkylene compounds are those described in Japanese Patent Publication Nos. 2-51477 and 3-34790, and the esterified alkoxylated amines described in EP-A-117,108 and EP-A-326,356.

It is within the scope of the invention to use two or more additional flow improvers advantageously selected from one or more of the different classes outlined above.

If an additional flow improver is employed, it is advantageously employed in a proportion within the range of from 0.01% to 1%, advantageously 0.05% to 0.5%, and preferably from 0.075 to 0.25%, by weight, based on the weight of fuel.

The pour point depressant additive of the invention may also be used in combination with one or more other co-additives such as known in the art, for example the following: detergents, particulate emission reducers, storage stabilizers, antioxidants, corrosion inhibitors, dehazers, demulsifiers, antifoaming agents, cetane improvers, cosolvents, package compatibilizers, and lubricity additives.

Additive concentrates according to the invention advantageously contain between 3 and 75%, preferably between 10 and 65%, of the pour point depressant additive in an oil or a solvent miscible with oil.

The concentrate comprising the additive in admixture with a suitable solvent are convenient as a means for incorporating the additive into bulk oil such as distillate fuel, which incorporation may be done by methods known in the art. The concentrates may also contain the other additives as required and preferably contain from 3 to 75 wt %, more preferably 3 to 60 wt %, most preferably 10 to 50 wt % of the additives preferably soluble in oil. Examples of solvent are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; alcohols and/or esters; and paraffinic hydrocarbons such as hexane and pentane and isoparaffins. The solvent must, of course, be selected having regard to its compatibility with the additive and with the oil.

The oil, preferably crude oil or fuel oil, composition of the invention advantageously contains the pour point depressant polymer of the invention in a proportion of 0.0005% to 1%, advantageously 0.001 to 0.1%, and preferably 0.01 to 0.06% by weight, based on the weight of oil.

In one embodiment, the oil-containing composition of the invention comprises crude oil, i.e. oil obtained directly from drilling and before refining.

The oil may be a lubricating oil, which may be an animal, vegetable or mineral oil, such, for example, as petroleum oil fractions ranging from naphthas or spindle oil to SAE 30, 40 or 50 lubricating oil grades, castor oil, fish oils, oxidized mineral oil, or biodiesels. Such oils may contain additives depending on its intended use; examples are viscosity index improvers such as ethylene-propylene copolymers, succinic acid based dispersants, metal containing dispersant additives and zinc dialkyldithiophosphate antiwear additives. The pour point depressant of this invention may be suitable for use in lubricating oils as a flow improver, pour point depressant or dewaxing aid.

In another embodiment the oil is a fuel oil, e.g., a petroleum-based fuel oil, especially a middle distillate fuel oil. Such distillate fuel oils generally boil within the range of from 110° C. to 500° C., e.g. 150° C. to 400° C. The fuel oil may comprise atmospheric distillate or vacuum distillate, cracked gas oil, or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain minor amounts, e.g. up to 35 wt %, of vacuum gas oil or cracked gas oil or of both. The above-mentioned low temperature flow problem is most usually encountered with diesel fuels and with heating oils. The invention is also applicable to vegetable-based fuel oils, for example rapeseed oil, used alone or in admixture with a petroleum distillate oil.

The invention will now be illustrated by the following nonlimiting example.

Example 1

Aromatic 150 (about 25% by weight of the product), C-20-24 Alpha Olefin (1.0 mole), and Maleic Anhydride (1.15 moles) are stirred in a flask equipped with an inert nitrogen subsurface sparge to eliminate air from the product and overhead and set for total reflux. The mixture is heated to 130° C. and then tert-butyl peroxybenzoate (0.02 moles) is slowly added continuously over a two to three hour period while maintaining the temperature at 130° C. and then allowed to react in for an additional hour. The flask is then set to collect distillate and the premelted tallowamine (1.15 moles) is then added to the mixture allowing the exotherm along with external heating to hold the product at 130-150° C. for 2 hours. Water will be collected as the imide is formed during this step. The resulting product was tested as a potential wax crystalline modifier against our current product (PC-105) used for this application. The pour point test results (attached) show that the experimental product (labeled RLC-2) was better at 200 ppm treating levels than our current PC-105 (labeled RLC-1) at 600 ppm treating levels. When the experimental product was used at the 600 ppm treating levels, it was even more effective (i.e. reduced the pour point of the crude all the way to 20° F.) at reducing the pour point of the crude that would normally not flow at 70° F. without treatment.

The pour point test results are compiled in Table 1, below.

TABLE 1

| Sample Analysis (D5853-95, Procedure 9.1.5) Test Description: Akzonobel Pour Point Depressant Evaluation | | | | | |
|---|---|---|---|---|---|
| | Sample ID | | | | |
| | GoM Crude | GoM Crude | GoM Crude | GoM Crude | GoM Crude |
| | Sample Description: | | | | |
| | No Additive | 200 ppm RLC-1 | 600 ppm RLC-1 | 200 ppm RLC-2 | 600 ppm RLC-2 |
| | Start Time | | | | |
| | 9:17 | 9:17 | 9:17 | 9:17 | 9:17 |
| | Start Temp. | | | | |
| | 120 F. | 120 F. | 120 F. | 120 F. | 120 F. |
| Bath 2 (70° F.) | Time: 13:00 | | | | |
| 115° F. | Flowing | Flowing | Flowing | Flowing | Flowing |
| 110° F. | ✓ | ✓ | ✓ | ✓ | ✓ |
| 105° F. | ✓ | ✓ | ✓ | ✓ | ✓ |
| 100° F. | ✓ | ✓ | ✓ | ✓ | ✓ |
| 95° F. | ✓ | ✓ | ✓ | ✓ | ✓ |
| 90° F. | ✓ | ✓ | ✓ | ✓ | ✓ |
| 85° F. | ✓ | ✓ | ✓ | ✓ | ✓ |
| Bath 3 (32° F.) | Time: 13:50 | | | | |
| 80° F. | ✓ | ✓ | ✓ | ✓ | ✓ |
| 75° F. | ✓ | ✓ | ✓ | ✓ | ✓ |
| 70° F. | No Flow | No Flow | ✓ | ✓ | ✓ |
| 65° F. | ϵ | ϵ | ✓ | ✓ | ✓ |
| 60° F. | ϵ | ϵ | No Flow | ✓ | ✓ |
| 55° F. | ϵ | ϵ | ϵ | ✓ | ✓ |
| 50° F. | ϵ | ϵ | ϵ | ✓ | ✓ |
| Bath 4 (0° F.) | Time: 14:44 | ϵ | ϵ | ϵ | ϵ |
| 45° F. | ϵ | ϵ | ϵ | ✓ | ✓ |
| 40° F. | ϵ | ϵ | ϵ | No Flow | ✓ |
| 35° F. | ϵ | ϵ | ϵ | ϵ | ✓ |
| 30° F. | ϵ | ϵ | ϵ | ϵ | ✓ |
| 25° F. | ϵ | ϵ | ϵ | ϵ | ✓ |
| 20° F. | ϵ | ϵ | ϵ | ϵ | ✓ |
| 15° F. | ϵ | ϵ | ϵ | ϵ | No Flow |
| Bath 5 (−27° F.) | Time: | | | | |
| 10° F. | ϵ | ϵ | ϵ | ϵ | ϵ |
| 5° F. | ϵ | ϵ | ϵ | ϵ | ϵ |

What is claimed is:

1. A crude oil composition having improved low temperature properties comprising crude oil and an effective amount of a pour point depressant additive composition that comprises at least one pour point depressant additive of the formula I:

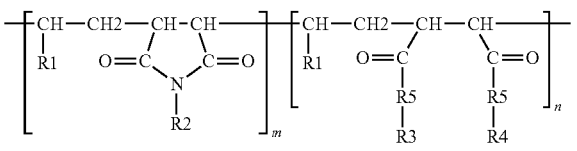

wherein each $R^1$ is independently selected from H or a hydrocarbyl group having from 1 to 50 carbon atoms, $R^2$, $R^3$ and $R^4$ are each independently selected from hydrogen or a hydrocarbyl groups containing from 1 up to 50 carbon atoms, m is an integer of from 1 to 50, n is an integer of from 0 to 50, and each $R^5$ is independently selected from O and NH.

2. The composition of claim 1 wherein $R^1$ is H or a $C_6$-$C_{30}$ saturated or unsaturated, substituted, or unsubstituted alkyl group, $R^2$ and $R^3$ are each independently selected from $C_6$-$C_{30}$ saturated or unsaturated, substituted, or unsubstituted alkyl groups; m is an integer of from 1 to 30 and n is an integer of from 1-30.

3. The composition of claim 1 wherein $R^1$ is H or a $C_8$-$C_{24}$ saturated or unsaturated, substituted, or unsubstituted alkyl group $R^2$ and $R^3$ are each independently selected from $C_8$-$C_{24}$ saturated or unsaturated, substituted or unsubstituted alkyl groups; m is an integer of from 1 to 30 and n is an integer of from 1-20.

4. The composition of claim 1 wherein said oil composition having improved low temperature properties comprises 0.0001% to 1% by weight of the pour point depressant additive composition of the invention, based on the weight of oil.

5. The composition of claim 1 wherein the oil has a wax content of 0.1 to 20% by weight, measured at 10 degrees below wax appearance temperature.

6. The composition of claim 1 one or more other co-additives such as known in the art, for example the following: detergents, particulate emission reducers, storage stabilizers, antioxidants, corrosion inhibitors, dehazers, demulsifiers, antifoaming agents, cetane improvers, cosolvents, package compatibilizers, and lubricity additives.

7. A pour point depressant additive concentrate for crude oil that comprises at least one pour point depressant additive of the formula:

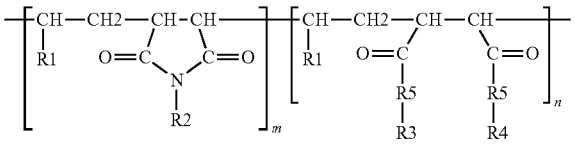

wherein each $R^1$ is independently selected from H or a hydrocarbyl group having from 1 to 50 carbon atoms, $R^2$, $R^3$ and $R^4$ are each independently selected from hydrogen or a hydrocarbyl groups containing from 1 up to 50 carbon atoms, m is an integer of from 1 to 50, n is an integer of from 0 to 50, and each $R^5$ is independently selected from O and NH.

8. The concentrate of claim 7 wherein $R^1$ is H or a $C_6$-$C_{30}$ saturated or unsaturated, substituted or unsubstituted alkyl group $R^2$ and $R^3$ are each independently selected from $C_6$-$C_{30}$ saturated or unsaturated, substituted or unsubstituted alkyl groups; m is an integer of from 1 to 30 and n is an integer of from 1-30.

9. The concentrate of claim 7 wherein $R^1$ is H or a $C_8$-$C_{24}$ saturated or unsaturated, substituted or unsubstituted alkyl group, $R^2$ and $R^3$ are each independently selected from $C_8$-$C_{24}$ saturated or unsaturated, substituted or unsubstituted alkyl groups; m is an integer of from 1 to 30 and n is an integer of from 1-20.

10. The concentrate of claim 7 wherein said solvent an organic solvent.

11. The concentrate of claim 7 wherein said organic solvent is selected from the group consisting of naphtha, kerosene, diesel, heater oil; aromatic hydrocarbon fraction, alcohols, esters, hexane, pentane, isoparaffins and mixtures thereof.

12. The concentrate of claim 7 that contains between 3 and 75% of said pour point depressant additive.

13. The concentrate of claim 12 that contains between 10 and 65%, of the pour point depressant additive.

14. A method of improving the low temperature flow properties of crude oil which comprises adding to said oil an effective amount of a pour point depressant additive composition that comprises at least one pour point depressant additive of the formula:

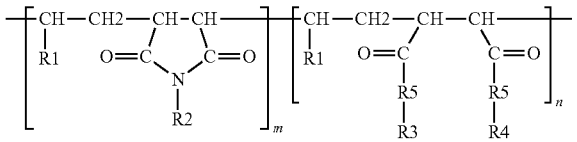

wherein each $R^1$ is independently selected from H or a hydrocarbyl group having from 1 to 50 carbon atoms, $R^2$, $R^3$ and $R^4$ are each independently selected from hydrogen or a hydrocarbyl groups containing from 1 up to 50 carbon atoms, m is an integer of from 1 to 50, n is an integer of from 0 to 50, and each $R^5$ is independently selected from 0 and NH.

15. The method of claim 14 wherein $R^1$ is H or a $C_6$-$C_{30}$ saturated or unsaturated, substituted or unsubstituted alkyl group, $R^2$ and $R^3$ are each independently selected from $C_6$-$C_{30}$ saturated or unsaturated, substituted or unsubstituted alkyl groups; m is an integer of from 1 to 50, and n is an integer of from 1-30.

16. The method of claim 15 wherein $R^1$ is H or a $C_8$-$C_{24}$ saturated or unsaturated, substituted or unsubstituted alkyl group, $R^2$ and $R^3$ are each independently selected from $C_8$-$C_{24}$ saturated or unsaturated, substituted or unsubstituted alkyl groups; m is an integer of from 1 to 50 and n is an integer of from 1-20.

17. The method of claim 14 wherein 0.0005% to 1% by weight of the pour point depressant additive composition, based on the weight of oil, is added.

* * * * *